US006283073B1

(12) United States Patent
Izuo et al.

(10) Patent No.: US 6,283,073 B1
(45) Date of Patent: Sep. 4, 2001

(54) SOLENOID-OPERATED VALVE CONTROL APPARATUS FOR INTERNAL COMBUSTION ENGINE

(75) Inventors: Takashi Izuo; Masahiko Asano, both of Toyota; Tatsuo Iida, Anjo; Hiroyuki Hattori, Toyota, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/565,179

(22) Filed: May 3, 2000

(30) Foreign Application Priority Data

May 12, 1999 (JP) ..... 11-131367

(51) Int. Cl.[7] ..... F01L 9/04; F16K 31/06

(52) U.S. Cl. ..... 123/90.11; 123/90.28; 123/188.8

(58) Field of Search ..... 123/90.11, 90.28, 123/90.29, 90.3, 188.8

(56) References Cited

U.S. PATENT DOCUMENTS 3,037,494 * 6/1962 Kirkpatrick et al. ..... 123/188.1
3,090,370 * 5/1963 Kimball ..... 123/188.7
4,309,966 * 1/1982 Klomp ..... 123/90.28
5,915,347 * 6/1999 Yanai et al. ..... 123/90.11
5,964,192 * 10/1999 Ishii ..... 123/90.11
6,044,814 * 4/2000 Fuwa ..... 123/90.11

FOREIGN PATENT DOCUMENTS

HEI 9-250318 9/1997 (JP) .

* cited by examiner

*Primary Examiner*—Weilun Lo
(74) *Attorney, Agent, or Firm*—Kenyon & Kenyon

(57) ABSTRACT

A control apparatus for a solenoid-operated valve that functions as an intake or exhaust valve of an internal combustion engine includes a lower spring biasing a valve body of the valve in a valve closing direction and upper and lower coils disposed above and below an armature for generating electromagnetic forces to move the valve body in the valve closing and valve opening directions. After a request for closing of the valve body is made, command currents are supplied to the upper and lower coils in suitable timing to increase the speed at which the valve body is seated against a valve seat. As the valve body rotates about its axis due to the action of the lower spring in the course of moving toward the valve seat, it is possible to crush and remove carbon between the valve body and the valve seat without causing local wear of the valve body.

26 Claims, 3 Drawing Sheets

SOLENOID-OPERATED VALVE CONTROL APPARATUS FOR INTERNAL COMBUSTION ENGINE

INCORPORATION BY REFERENCE

The disclosure of Japanese Patent Application No. HEI 11-131367 filed on May 12, 1999 including the specification, drawings and abstract is incorporated herein by reference in its entirety.

BACKGROUND OF THE INVENTION

1. Field of the Invention

The present invention relates to a solenoid-operated valve control apparatus for an internal combustion engine, and in particular to such a solenoid-operated valve control apparatus that is adapted to open and close a valve body that functions as an intake or exhaust valve of the engine, using spring force and electromagnetic force, and a solenoid-operated valve control method.

2. Description of the Related Art

An example of a known solenoid-operated valve control apparatuses for an internal combustion engine is disclosed in Japanese Patent Laid-Open Publication No. HEI 9-250318. In the solenoid-operated valve control apparatus of the engine, each solenoid-operated valve includes a valve body that functions as an intake or exhaust valve of the engine, a pair of springs that biases the valve body in a valve opening direction and in a valve closing direction, and a pair of electromagnetic coils that generate electromagnetic forces that move the valve body in the valve opening direction and the valve closing direction. With this arrangement, the known solenoid-operated valve described above is able to drive the valve body to open and close the same by alternately energizing each of the electromagnetic coils at an appropriate timing.

When the engine is operated for a long period of time, carbon produced by oxidation or deterioration of engine oil or fuel, for example, may be deposited between the intake or exhaust valve and a valve seat against which the intake/exhaust valve is seated. If carbon is deposited in such a manner, the valve body is not appropriately seated on the valve seat upon closing of the valve body, and sealing between the valve body and the valve seat may deteriorate when the valve body is placed in the closed position.

In this apparatus, an exciting current supplied to the upper coil while the valve is held in the closed position is increased to a value larger than that during normal operations. In this method, an electromagnetic force applied in the valve closing direction is increased while the valve body is held in the closed position so that the above-described carbon deposits can be crushed between the valve body and the valve seat. With the apparatus of the related art, therefore, it is possible to prevent a reduction in the sealing between the valve body and the valve seat due to the presence of carbon when the valve body is in the closed position.

In the above-described apparatus, the electromagnetic force applied in the valve closing direction increases after the valve body has reached its closed position. Therefore, carbon deposited between the valve body and the valve seat will always be crushed by the same portion of the valve body. This may result in increased wear of a local area of the abutting face of the valve body on the valve seat.

SUMMARY OF THE INVENTION

The present invention was developed in the light of the above situation. It is therefore an object of the present invention to provide a solenoid-operated valve control apparatus for an internal combustion engine, which is able to remove carbon deposited between the valve body and the valve seat, without causing local wear of the valve body.

To accomplish the above object, the present invention provides a solenoid-operated valve control apparatus for an internal combustion engine, which includes at least one solenoid-operated valve including a valve body that functions as an intake or exhaust valve of the engine, a spring that biases the valve body in a valve closing direction, and an electromagnetic coil that generates an electromagnetic force that moves the valve body in the valve closing direction, and a current controller that controls current supplied to the electromagnetic coil so that a valve body speed at which the valve body moves toward a valve seat increases at certain points of time to a speed higher than a normal valve body speed.

According to the present invention, the waveform of current applied to the electromagnetic coil is controlled so that the valve body speed increases at certain points of time to a speed higher than a normal valve body speed. If the speed of seating the valve body is increased, carbon that has deposited between the valve body and the valve seat can be surely crushed therebetween. Furthermore, the valve body rotates about its axis due to the action of the spring while moving toward the valve seat Since the valve body displaces or moves at a certain speed in the valve closing direction while rotating about its axis, the carbon present between the valve body and the valve seat receives a force in the valve closing direction and a rotational force about the valve axis when the valve body is seated against the valve seat. Thus, the valve body is able to crush carbon while rotating about its axis, without always using the same portion thereof for crushing carbon. According to the present invention, therefore, it is possible to remove carbon that has deposited between the valve body and the valve seat, without causing local wear of the valve body.

In one preferred form of the invention, the current controller may increase the valve body speed when the engine operates with a large operating sound.

If the valve body speed at which the valve body moves toward the valve seat is increased according to the present invention, operating noise that occurs upon collision between the valve body and the valve seat is increased. In view of this problem, the current controller is adapted to control the waveform of current applied to the electromagnetic coil so that the valve body speed is increased when the engine is operating with a large operating sound. Thus, the present invention makes it possible to remove carbon that has deposited between the valve body and the valve seat, while preventing the operating noise that increases with an increase in the valve body speed from being offensive to the ear.

In another form of the invention, the current controller may increase the valve body speed each time a given period of time elapses.

In the above form of the invention, the current controller controls the waveform of current applied to the electromagnetic coil so that the valve body speed is increased each time a given period of time elapses or at given time intervals. Where the valve body speed is increased each time a given period of time elapses, the frequency of occurrence of an operating noise that increases with an increase in the valve body speed is limited or reduced as compared with the case where the valve body speed is increased each time the valve body is seated against the valve seat. Thus, the present invention makes it possible to remove carbon that has deposited between the valve body and the valve seat while suppressing an increase in the operating noise with an increase in the valve body speed.

In a further form of the invention, the engine may include a plurality of solenoid-operated valves, and the current controller may increase the valve body speed at different points of time with respect to the respective solenoid-operated valves or with respect to respective groups of the solenoid-operated valves.

In the above form of the invention, the engine has a plurality of solenoid-operated valves. The current controller controls the waveform of current applied to the electromagnetic coil so as to increase the valve body speed at different points of time with respect to the respective solenoid-operated valves or with respect to respective groups of the solenoid-operated valves. Thus, the present invention makes it possible to remove carbon while suppressing or restricting an increase in the operating noise resulting from an increase in the speed of seating the valve body.

According to another aspect of the present invention, a solenoid-operated valve control method of an internal combustion engine is provided in which current to be supplied to the electromagnetic coil is controlled so that a valve body speed at which the valve body moves toward a valve seat increases at certain points of time to be higher than a normal valve body speed.

DETAILED DESCRIPTION OF THE PREFERRED EMBODIMENTS

Figure 1:
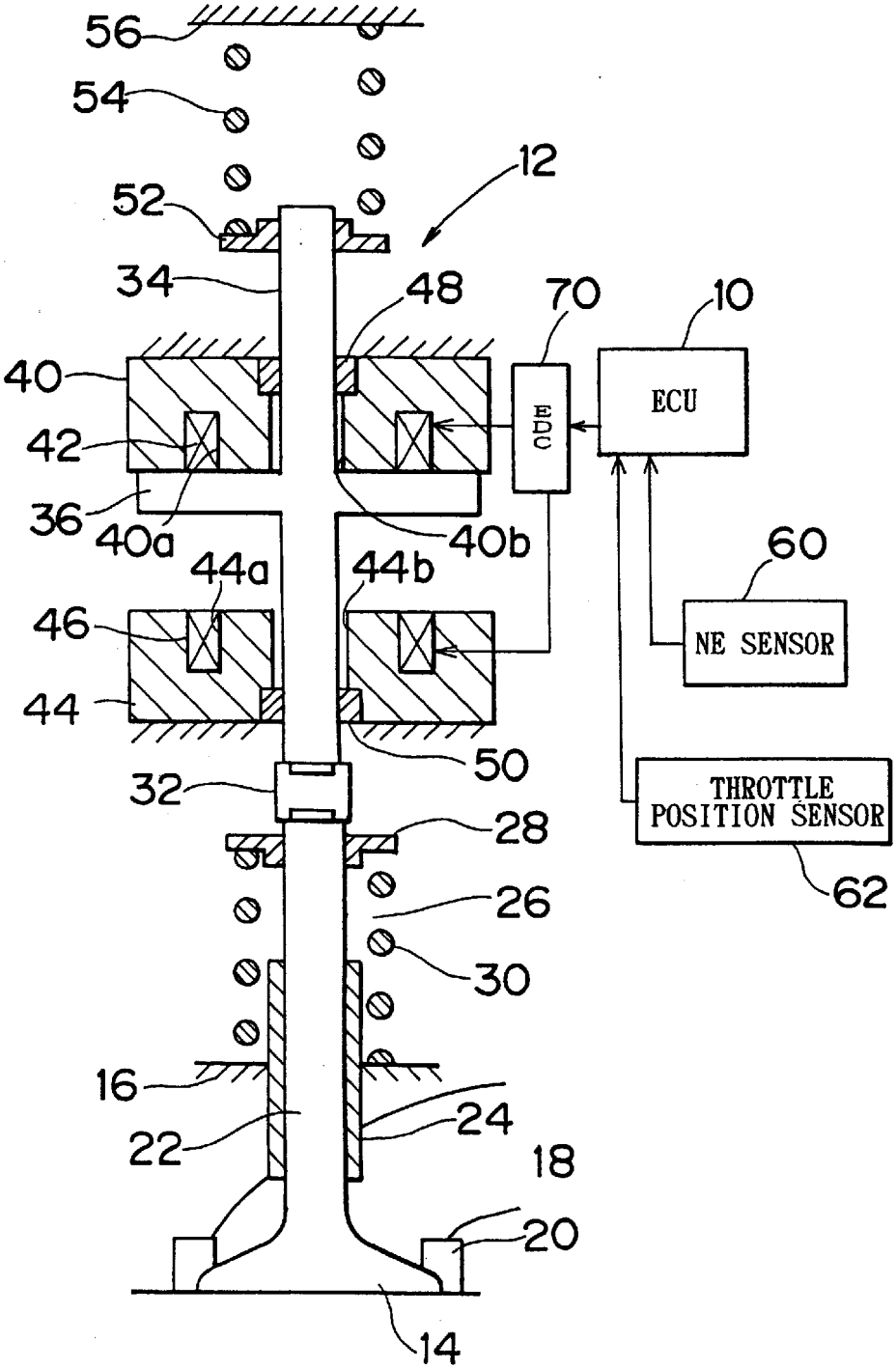
FIG. 1 is a view showing the construction of a solenoid-operated valve control apparatus for an internal combustion engine according to one embodiment of the present invention.

FIG. 1 shows the construction of a solenoid-operated valve control apparatus (hereinafter simply called "valve control apparatus") of an internal combustion engine as one preferred embodiment of the present invention. The valve control apparatus includes an electronic control unit (which will be abbreviated to "ECU"), and its operation is controlled by the ECU 10. In the present embodiment, the engine has a plurality of cylinders (e.g., four cylinders). Each of these cylinders is provided with two intake valves and two exhaust valves.

As shown in FIG. 1, the valve control apparatus includes solenoid-operated valves 12 corresponding to the respective intake valves and exhaust valves. It is to be noted that only one solenoid-operated valve 12, among a plurality of solenoid-operated valves, is illustrated in FIG. 1. The solenoid-operated valve 12 includes a valve body 14 that functions as an intake valve or exhaust valve of the engine. The valve body 14 is mounted on a cylinder head 16 such that its lower end portion as viewed in FIG. 1 is exposed to a combustion chamber of the engine. Ports 18 serving as intake ports and exhaust ports are formed in the cylinder head 16. A valve seat 20 is provided at an opening of each port 18 that faces the combustion chamber. The port 18 is blocked or shut off when the valve body 14 is seated against the valve seat 20, and is brought into communication with the combustion chamber when the valve body 14 is spaced or lifted away from the valve seat 20.

A valve stem 22 that extends upwards is formed as an integral part of the valve body 14. A valve guide 24, which is provided within the cylinder head 16, serves to hold the valve stem 22 slidably in the axial direction and rotatably about the axis of the stem 22. A lower spring holding space 26 is formed in a cylindrical shape in a portion that surrounds substantially the upper half of the valve stem 22. The upper portion of the valve guide 24 is exposed to the interior of the lower spring holding space 26.

A lower retainer 28 is fixed to the upper end portion of the valve stem 22. A lower spring 30 is disposed between the lower retainer 28 and the bottom wall of the lower spring holding space 26, to generate a biasing force that acts against the lower face of the lower retainer 28 and the bottom wall of the space 26. The lower spring 30 pushes up the lower retainer 28, so as to bias the valve stem 22 and the valve body 14 upwards as viewed in FIG. 1, namely, in a direction in which the valve body 14 heads for the valve seat 20. In the following description, the direction in which the valve body 14 heads for the valve seat 20 will be called "valve closing direction", and the direction in which the valve body 14 is separated or spaced away from the valve seat 20 will be called "valve opening direction".

An armature stem 34 is disposed coaxially with the valve stem 22, to be located above the valve stem 22 with a valve lash adjuster 32 interposed between the armature stem 34 and the valve stem 22. The valve lash adjuster 32 incorporates a spring, and is adapted to expand or contract in accordance with relative displacement between the valve body 14 and the armature 36. More specifically, when the valve body 14 is in the open state, the valve lash adjuster 32 slightly contracts under biasing forces of the lower spring 30 and an upper spring which will be described later. After the valve body 14 rests upon the valve seat 20, on the other hand, the valve lash adjuster 32 expands until the armature 36 abuts on an upper core 40 as described later under the action of the above spring. In this manner, the valve lash adjuster 32 operates to absorb relative displacement between the valve body 14 and the armature 36, which may arise from a difference in the thermal expansion between the valve body 14 and the valve seat 20 and wear of abutting faces of the valve body 14 and valve seat 20, thereby to prevent a clearance from being formed between the valve body 14 and the armature 36. Thus, the use of the valve lash adjuster 32 leads to reduction in operating noise that would occur upon collision of the upper end portion of the valve stem 22 against the lower end portion of the armature stem 34.

The armature 36 is joined to the periphery of an axially middle portion of the armature stem 34. The armature 36 is an annular member that is formed of a soft magnetic material. An upper core 40 and an upper coil 42 are disposed above the armature 36, and a lower core 44 and a lower coil 46 are disposed below the armature 36. Each of the upper core 40 and the lower core 44 has an annular groove 40*a*, 44*a* formed in its surface that faces the armature 36, and a through-hole 40*b*, 44*b* that extends through a central portion thereof in the axial direction.

An upper coil 42 and a lower coil 46 are respectively received in the annular grooves 40*a*, 44*a* formed in the upper core 40 and the lower core 44. A bearing 48 is disposed in an upper end portion of the through-hole 40*b* of the upper core 40, and a bearing 50 is disposed in a lower end portion of the through-hole 44*b* of the lower core 44. The armature stem 34, which extends through the through-holes 40*b*, 44*b*, are axially slidably supported by the bearings 48, 50.

An upper retainer 52 is fixed to an upper end portion of the armature stem 34. The lower end face of the upper spring 54 abuts on the upper face of the upper retainer 52. The upper end of the upper spring 54 is supported by an upper spring holding surface 56. With this arrangement, the upper spring 54 pushes down the upper retainer 52, and eventually biases the armature stem 34 downwards in FIG. 1, namely, in the valve opening direction.

In the solenoid-operated valve 12, the positions of the upper core 40 and the lower core 44 are adjusted such that the upper core 40 and the lower core 44 are spaced a certain distance from each other. The position of the upper spring holding surface 56 is adjusted so that the armature 36 is located at a middle point between the upper core 40 and the lower core 44 when it is placed in its neutral position.

The upper coil 42 and lower coil 46 provided in the solenoid-operated valve 12 are electrically connected to a drive circuit (hereinafter referred to as "EDC"), which is in turn connected to the ECU 10. The ECU 10 supplies a command signal to the EDC 70 so that the valve body 14 is driven to be placed in an appropriate one of the open and closed positions. The EDC 70 supplies command current to the upper coil 42 and the lower coil 46, based on the command signal supplied from the ECU 10.

To the ECU 10 is connected an NE sensor 60 that generates a pulse signal with a cycle that depends upon the rotating speed NE of the engine. The ECU 10 detects the engine speed NE based on the output signal of the NE sensor 60. To the ECU 10 is also connected a throttle position sensor 62 that generates a signal indicative of the opening of a throttle valve. The ECU 10 detects the throttle opening 0 based on the output signal of the throttle position sensor 62.

The operation of the solenoid-operated valve 12 will be now explained. When no exciting current is supplied to the upper coil 42 and lower coil 46, the armature 36 is maintained at its neutral position, namely, at a position intermediate between the upper core 40 and the lower core 44.

If exciting current is supplied to the upper coil 42 while the armature 36 is located at the position intermediate between the upper core 40 and the lower core 44, the upper coil 42 generates magnetic flux so as to cause electromagnetic force to act upon the armature 36 in the valve closing direction. As a result, the armature 36 moves until it abuts on the upper core 40, against the biasing force of the upper spring 54. With the armature 36 abutting upon the upper core 40, the valve body 14 is seated against valve seat 20, to be thus placed in the fully closed state. In the following description, the position at which the armature 36 abuts on the upper core 40 will be called "fully closed position" of the armature 36 and valve body 14.

When the supply of exciting current to the upper coil 42 is stopped while the valve body 14 is held in the fully closed position, the electromagnetic force that has acted upon the armature 36 ins the valve closing direction disappears. If the supply of exciting current to the upper coil 42 is stopped in the above-described condition, therefore, the armature 36 begins to displace or move along with the valve body 14 in the opening direction, under a biasing force generated by the upper spring 54.

While the armature 36 is moving in the valve opening direction, sliding friction arises between the valve stem 22 and the valve guide 24, and between the armature stem 34 and the bearings 48, 50. If exciting current is supplied to the lower coil 46 at a point of time when the amount of displacement of the armature 36 in the valve opening direction reaches a certain value, a force to pull or attract the armature 36 toward the lower core 44 is generated, namely, an electromagnetic force that moves the valve body 14 downwards in FIG. 1 is generated. The electromagnetic force acts on the armature 36, to compensate for the energy lost due to the sliding friction as described above, so that the armature 36 moves until it abuts on the lower core 44 against the biasing force of the lower spring 30. With the armature 36 being held in abutment with the lower core 44, the valve body 14 is placed in the fully open position. In the following description, the position at which the armature 36 abuts on the lower core 44 will be called "fully closed position" of the armature 36 and valve body 14.

When the supply of exciting current to the lower coil 46 is stopped while the valve body 14 is held in the open position, the electromagnetic force that has acted upon the armature 36 in the valve opening direction disappears. As a result, the armature 36 and valve body 14 begins to move in the valve closing direction under the biasing force of the lower spring 30. If exciting current is supplied to the upper coil 42 at a point of time when the amount of displacement of the armature 36 and valve body 14 reaches a certain value, an electromagnetic force generated by the upper coil 42 acts on and moves the armature 36, while compensating for the energy lost due to the sliding friction, until the armature 36 abuts on the upper core 40. With the armature 36 abutting on the upper core 40, the valve body 14 is placed again in the fully closed position.

In the manner as described above, the solenoid-operated valve 12 permits the valve body 14 to move to the fully closed position by supplying exciting current to the upper coil 42, and also permits the valve body 14 to move to the fully open position by supplying exciting current to the lower coil 46. Thus, the solenoid-operated valve 12 of the present embodiment allows the valve body 14 to be repeatedly reciprocated between the fully open position and the fully closed position by supplying exciting current alternately to the upper coil 42 and the lower coil 46 in suitable timing.

Figures 2A, 2B, 2C:
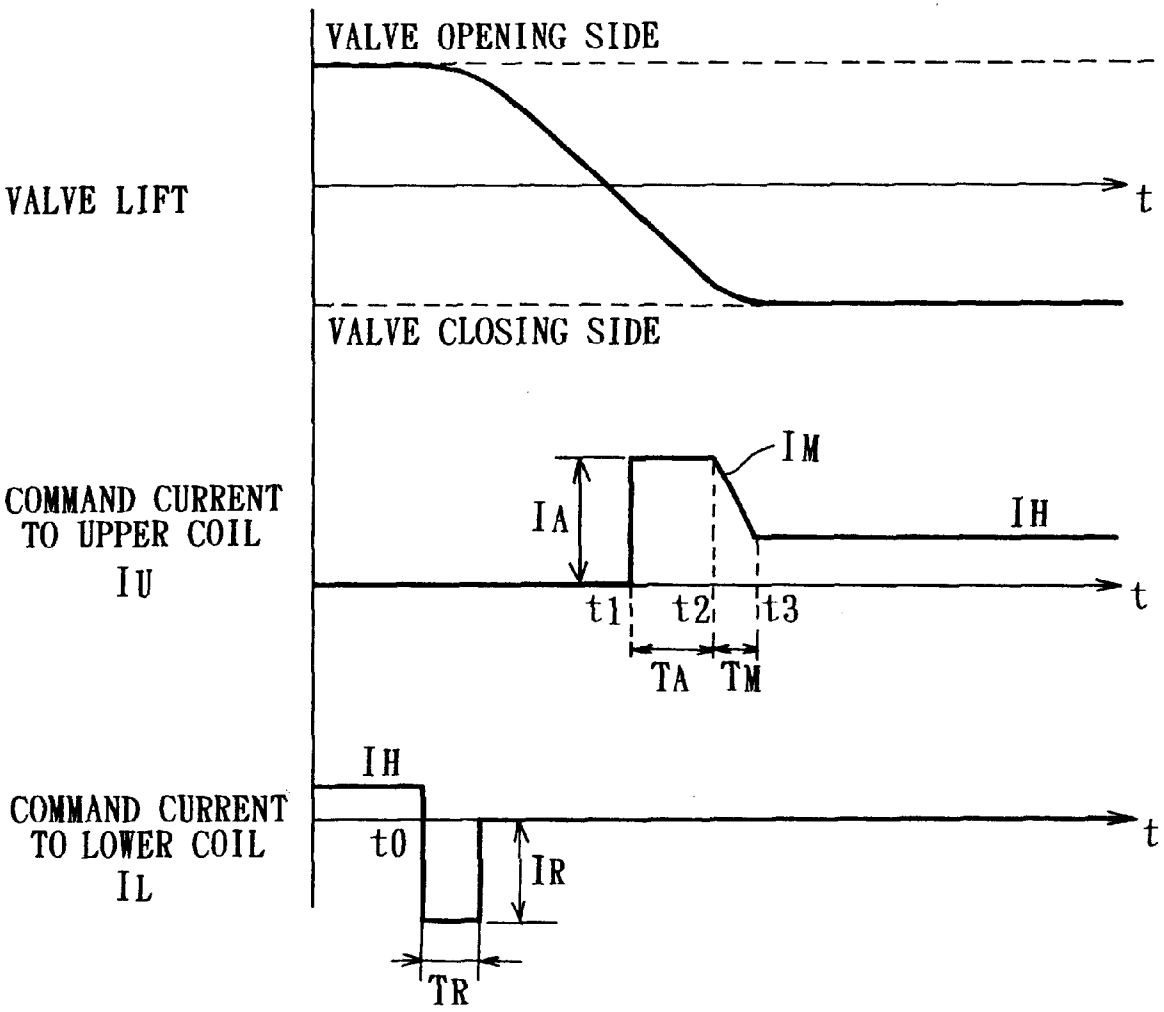
FIG. 2A is a time chart showing the valve lift displacement waveform of a valve body when the valve body moves from the fully open position to the fully closed position.
FIG. 2B is a time chart showing the waveform of command current to be supplied to an upper coil so as to move the valve body from the fully open position to the fully closed position.
FIG. 2C is a time chart showing the waveform of command current to be supplied to a lower coil so as to move the valve body from the fully open position to the fully closed position.

FIG. 2A shows a valve lift displacement waveform of the valve body 14 when it moves from the fully open position to the fully closed position. FIG. 2B and FIG. 2C show waveforms of command current that is supplied to the upper coil 42 and the lower coil 46, respectively, so as to move the valve body 14 from the fully open position to the fully closed position.

As shown in FIG. 2C, command current supplied to the lower coil 46 is kept equal to a certain holding current $I_H$ before a point of time "to". In this case, the valve body 14 is held at the fully open position, as shown in FIG. 2A. If a request for opening of the valve body 14 is made at the point of time to, releasing current $I_R$ that flows in a direction opposite to that of the holding current IH is supplied to the lower coil 46 for a certain period of time $T_R$. After supply of exciting current to each coil is stopped, a residual magnetic field remains around the coil. It is thus desirable to let such residual magnetic field disappear in a short time, so that the solenoid-operated valve 12 ensures excellent response. If releasing current $I_R$ is supplied to each coil in a direction opposite to that of the holding current $I_H$, the residual magnetic field as described above disappears in a short time. In the present embodiment, therefore, the releasing current $I_R$ is supplied to the lower coil 46 after the request for opening of the valve body 14 is made, so that the valve body 14 can be moved with good response in the valve closing direction.

Upon a lapse of certain time after the supply of command current to the lower coil 46 is stopped, the valve body 14 displaces or moves a certain distance from the fully open position toward the fully closed position, under the biasing force generated by the lower spring 30. Then, command current supplied to the upper coil 42 is controlled to a certain attraction current $I_A$ at a point of time "t1", as shown in FIG. 2B. The attraction current $I_A$ is kept supplied for a certain period of time $T_A$. With the command current to the upper coil 42 controlled in the above manner, a large electromagnetic force is generated which biases the armature 36 toward the upper core 40.

At a point of time "t2" at which the valve body 14 reaches the vicinity of the fully closed position, the command signal to the upper coil 42 is controlled to certain transition current $I_M$ for a certain period of time $T_M$. The transition current $I_M$ is reduced at a suitable slope as the valve body 14 approaches the fully closed position. It is generally noted that where exciting current to each coil is held constant, the electromagnetic force acting between the armature 36 and each core rapidly increases as the armature 36 gets close to the core. It is therefore desirable to reduce the command current supplied to each coil when the valve body 14 gets close to the fully closed position or the fully open position, so as to enable the valve body 14 to be sufficiently quietly attracted to and held at the fully closed position or the fully open position. In the present embodiment, therefore, the transition current $I_M$ that is smaller than the attraction current is supplied to the upper coil 42 after the valve body 14 reaches the vicinity of the valve body 14, thus assuring improved quietness and an excellent power saving characteristic.

Upon and after a point of time "t3" at which the valve body 14 abuts on the upper core 40, the command current to the upper coil 42 is controlled to the minimum holding current $I_H$ necessary for maintaining the valve body 14 in the fully closed position. In the present embodiment, therefore, electric power to be consumed can be minimized during the period in which the valve body 14 is held in the fully closed position.

In the present embodiment as described above, after the holding current $I_H$ is supplied to the lower coil 46, suitable command current is supplied to the lower coil 46 and upper coil 42 in suitable timing, so that the valve body 14 that had been held in the fully open position can be quickly and quietly moved to the fully closed position, and the valve body 14 is held in the fully closed position with reduced power consumption.

Where the internal combustion engine is operated for a long period of time, carbon produced through oxidation or deterioration of engine oil or fuel, for example, may be deposited or accumulated between the valve body 14 and the valve seat 20. In the present embodiment in which the valve lash adjuster 32 is interposed between the valve stem 22 and the armature stem 34, in particular, a relatively small force acts between the valve body 14 and the valve seat 20 when the valve body 14 is closed, and carbon is likely to deposit between the valve body 14 and the valve seat 20. It is therefore necessary to remove the carbon as described above without fail, so as to ensure sufficient sealing between the valve body 14 and the valve seat 20 in the engine.

As a method of removing carbon, it is proposed to increase the electromagnetic force applied in the valve closing direction during the period in which the valve body 14 is held in the fully closed position, thereby to crush the carbon between the valve body 14 and the valve seat 20. In this method, however, the electromagnetic force is increased after the valve body 14 reaches the fully closed position, and therefore the valve body 14 always crushes carbon at the same portion thereof, which may result in wear of a local area of the abutting face of the valve body 14 on the valve seat 20, as described above with regard to the related art In the present embodiment in which the valve lash adjuster 32 is interposed between the valve stem 22 and the armature stem 34, the force applied to the valve body 14 in the valve closing direction does not increase enough to crush carbon even with an increase in the electromagnetic force applied in the valve closing direction during the period in which the valve body 14 is held in the fully closed position.

In view of the above, the present embodiment employs another method of removing carbon, in which the valve body 14 is seated against the valve seat 20 at an increased seating speed. It has been experientially recognized that the valve body 14 is opened or closed while rotating about its axis due to the action of the lower spring 30. In the above-described method, therefore, the valve body 14 is adapted to crush carbon while rotating about the axis. It is thus possible to crust carbon without fail, while avoiding local wear of the valve body 14.

To increase the speed of seating the valve body 14 against the valve seat 20, it is effective to (1) increase the attraction current $I_A$ supplied to the upper coil 42, (2) extend the period of time $T_A$ of supplying the attraction current $I_A$, (3) extend the period of time $T_M$ in which the transition current $I_M$ is supplied to the upper coil 42, (4) increase the releasing current $I_R$ supplied to the lower coil 46, and (5) extend the period of time $T_R$ of supplying the releasing current $I_R$. The valve control apparatus of the engine according to the present embodiment carries out the operations of (1) through (5), thereby to increase the speed of seating the valve body 14 against the valve seat 20. In the following description, control operations to increase the speed of seating the valve body 14 against the valve seat 20 will be called "speed increase control".

If the speed increase control is performed, the sound of collision between the valve body 14 and the valve seat 20 and the sound of collision between the armature 36 and the upper core 40 are increased. To prevent the thus increased operating noise from being offensive to the ear, it is appropriate to execute the speed increase control under the situation where the engine is running with large operating sound, for example, in heavy-load, high-rotating-speed operating conditions.

In order to suppress the increase in the operating noise due to execution of the speed increase control, it is desirable to carry out the speed increase control not every time the valve body 14 is closed, namely, to put a limit to the frequency (the number of times) of carrying out the speed increase control. Since carbon is deposited between the valve body 14 and the valve seat 20 little by little as the engine is operating, a seal between the valve body 14 and the valve seat 20 will not deteriorate upon valve closing where only a slight amount of carbon is deposited. Accordingly, the speed increase control for crushing carbon need not be carried out each time the valve body 14 is closed.

In the view of the above point, therefore, the system of the present embodiment is adapted to execute speed increase control where carbon is estimated to have grown to some extent. In addition, where the engine is in a heavy-load, high-rotating-speed operating state, the speed increase control is executed more frequently than in the case where the engine is in a light-load, low-speed operating state.

Figure 3:
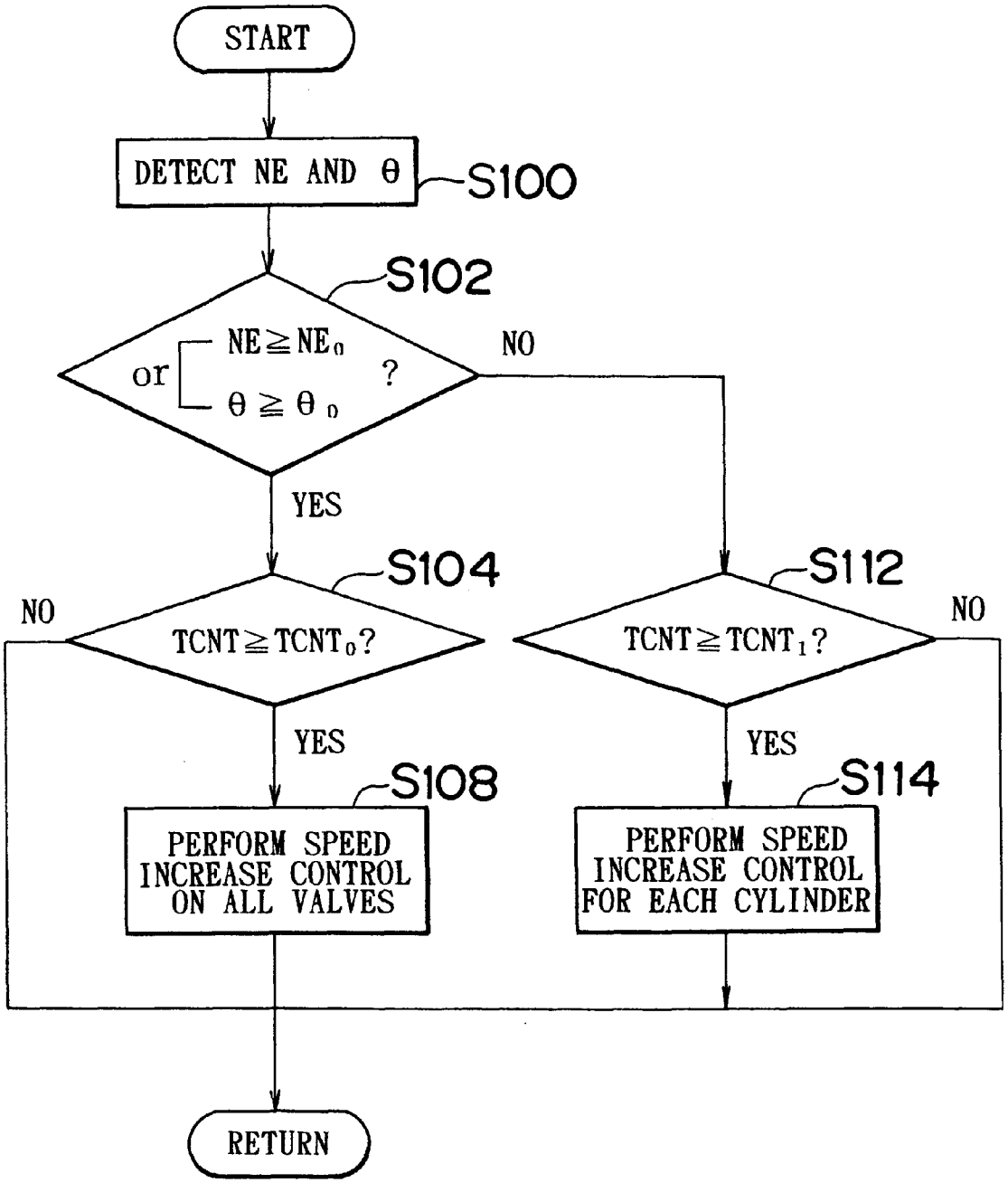
FIG. 3 is a flowchart of one example of control routine that is executed in one embodiment of the invention so as to carry out speed increase control.

FIG. 3 is a flowchart showing one example of control routine which the ECU 10 executes in the valve control apparatus of the present embodiment so as to perform speed increase control. The control routine of FIG. 3 is a periodic interrupt routine that is repeatedly started each time a given time elapses. Once the routine shown in FIG. 3 is started, step S100 is initially executed.

In step S100, the engine speed NE and throttle opening θ of the engine are detected based on the output signals of the NE sensor 60 and throttle position sensor 62.

Step S102 is then executed to determine whether the engine speed NE detected in the above step S100 is equal to or greater than a predetermined value $NE_0$ or not, or the throttle opening θ is equal to or greater than a predetermined value $\theta_0$ or not. The predetermined values $NE_0$ and $\theta_0$ are the minimum values of the engine speed NE and throttle opening θ at which the engine is supposed to generate operating sound large enough to make operating noise occurring upon execution of speed increase control non-offensive to the ear. Where NE is equal to or greater than $NE_0$ or θ is equal to or larger than $\theta_0$, the ECU 10 determines that the engine is in a heavy-load, high-rotating-speed operating state, and that the engine is generating a large operating sound. Where the relationship of $NE \geqq NE_0$ or $\theta \geqq \theta_0$ is satisfied, the control flow goes to step S104.

In step S104, the ECU 10 determines whether time TCNT measured from a point of time at which execution of the last speed increase control is finished reaches a predetermined time $TCNT_0$ with respect to a given solenoid-operated valve 12. If step S104 determines that the relationship of $TCNT \geqq TCNT_0$ is not satisfied, the current cycle of the routine is terminated. If the relationship of $TCNT \geqq TCNT_0$ is satisfied, on the other hand, the control flow goes to step S108.

In step S108, the speed increase control is executed with respect to all of the solenoid-operated valves 12 included in the engine, during one cycle of the engine. More specifically, after a request for opening of the valve body 14 is made, the waveforms of current applied to the upper coil 42 and lower coil 46 are modified with respect to all of the solenoid-operated values, so as to (1) increase the attraction current $I_A$ supplied to the upper coil 42, (2) extend the period $T_A$ of supplying the attraction current $I_A$, (3) extend the period $T_M$ in which the transition current $I_M$ is supplied to the upper coil 42, (4) increase the releasing current $I_R$ supplied to the lower coil 46, and (5) extend the period $T_R$ of supplying the releasing current $I_R$. After the operation of step S108 is finished, the current cycle of the control routine is terminated.

If the relationship of $NE \geqq NE_0$ or $\theta \geqq \theta_0$ is not satisfied in the above step S102, the ECU 10 determines that large operating sound is not generated in the engine. If a negative decision (NO) is obtained in step S102, therefore, the control flow goes to step S112.

In step S112, the ECU 10 determines whether the time TCNT measured from a point at which execution of the last speed increase control is finished reaches a predetermined time $TCNT_1$ or not. The predetermined time $TCNT_1$ is judged as being needed for carbon to be deposited or developed to some extent between the valve body 14 and the valve seat 20 after the last speed increase control is finished. In this connection, the predetermined time $TCNT_0$ used in the above step S104 is set to be shorter than the predetermined time $TCNT_1$ used in step S112. If step S112 determines that the relationship of $TCNT \geqq TCNT_1$ is not satisfied, i.e., TCNT is less than $TCNT_1$, the current cycle of the routine is terminated. If the relationship of $TCNT \geqq TCNT_1$ is satisfied, the control flow goes to step S114.

In step S114, the speed increase control is performed for each cylinder at a time with respect to all of the solenoid-operated valves 12 in the engine. More specifically, the waveforms of current applied to the upper coil 42 and lower coil 46 are modified so that the operations of (1) through (5) are carried out in all solenoid-operated valves 12 within one cylinder during one cycle of the engine, and the cylinder for which the modification of the current waveforms is effected is successively replaced by another one upon each cycle of the engine. When the operation of this step S114 is finished, the current cycle of the control routine is terminated.

With the control routine as described above, it is possible to (1) increase the attraction current $I_A$ supplied to the upper coil 42, (2) extend the period $T_A$ of supplying the attraction current $I_A$, (3) extend the period $T_M$ in which the transition current $I_M$ is supplied to the upper coil 42, (4) increase the releasing current $I_R$ supplied to the lower coil 46, and (5) extend the period $T_R$ of supplying the releasing current $I_R$ in suitable timing, as compared with those in normal operations. If the command currents with the thus modified waveforms are supplied to the upper coil 42 and lower coil 46, an electromagnetic force applied in the direction of closing the valve body 14 is increased. In the present embodiment, therefore, the speed of seating the valve body 14 against the valve seat 20 can be increased by carrying out the speed increase control. With the speed of seating the valve body 14 thus increased, carbon can be surely crushed between the valve body 14 and the valve seat 20.

In the meantime, the valve body 14 is rotated about its own axis due to the action of the lower spring 30 when it moves toward the valve seat 20. Hence, the valve body 14 cooperates with the valve seat 20 to crush carbon therebetween while rotating about its axis, and is thus able to prevent the same portion thereof from being always used for crushing carbon. It is thus possible in the present embodiment to avoid local wear of the valve body 14 due to crushing of carbon between the valve body 14 and the valve seat 20. Thus, the valve control apparatus of the present embodiment makes it possible to remove carbon without causing local wear of the valve body 14.

In the present embodiment, removal of carbon can be accomplished by increasing the electromagnetic force applied in the valve closing direction during the time in which the valve body 14 moves toward the fully closed position. Even where the valve lash adjuster 32 is interposed between the valve stem 22 and the armature stem 34 in the solenoid-operated valve 12, therefore, it is possible to crush carbon by causing the valve body 14 to be seated against the valve seat 20 upon closing of the valve, at a higher speed than that during normal operations. Thus, in the valve control apparatus of the present embodiment, carbon can be removed without fail even where the valve lash adjuster 32 is provided.

According to the above-described routine as shown in FIG. 3, the speed increase control for removing carbon can be performed at certain time intervals or each time a certain time elapses. Where the speed increase control is performed in such timing, the speed of seating the valve body 14 is not increased every time the valve body 14 is closed, and large operating noise due to the speed increase control occurs at a reduced frequency. In the present embodiment, therefore, the operating noise resulting from execution of the speed increase control can be prevented from being increased. Thus, the present embodiment makes it possible to remove carbon through speed increase control, while suppressing an increase in the operating noise with an increase in the speed of seating the valve body 14.

According to the control routine of FIG. 3, the speed increase control for removing carbon is frequently performed when the engine is in a heavy-load, high-rotating-speed operating state, and less frequently performed when the engine is in a light-load, low-rotating-speed operating state. In the present embodiment, therefore, large operating noise occurs more frequently in a heavy-load, high-rotating-speed engine operating region, while operating noise occurs at relatively large time intervals in a light-load, low-rotating-speed engine operating region. It is generally noted that the operating sound generated by the engine is increased as the engine is brought into a heavy-load, high-rotating-speed operating state. In the present embodiment, therefore, the operating noise that increases upon execution of the speed increase control is prevented from being offensive to the ear. Thus, the present embodiment makes it possible to remove carbon through the speed increase control, while preventing the operating noise that increases with an increase in the speed of seating the valve body 14 from being offensive to the ear.

Furthermore, according to the control routine as shown in FIG. 3, the speed increase control is performed with respect to all of the solenoid-operated valve 12 during one cycle of the engine when the engine is in a heavy-load, high-rotating-speed operating state. When the engine is in a light-load, low-rotating-speed operating state, on the other hand, the speed increase control is performed with respect to one cylinder after another while a currently selected cylinder to be controlled is replaced by another cylinder upon each cycle of the engine. In the present embodiment, the speed increase control is performed on the respective solenoid-operated valves 12 at different points of time or at suitable time intervals, and therefore the operating noise resulting from the speed increase control can be prevented from being increased. Thus, the present embodiment makes it possible to remove carbon through the speed increase control, while suppressing an increase in the operating noise with an increase in the speed of seating the valve body 14.

In the present embodiment, the speed increase control is not performed each time the valve body 14 is closed. In the valve control apparatus of the present embodiment, therefore, an increase in the power consumption due to execution of the speed increase control can be limited to a minimum.

In the illustrated embodiment, the lower spring 30 corresponds to "spring" as recited in the appended claims, and the upper coil 42 and the lower coil 46 correspond to "electromagnetic coil" as recited in the claims, while the ECU 20 performs the abovedescribed operations (1) through (5) in suitable timing, to thus provide "current controller" as recited in the claims.

In the illustrated embodiment, the speed increase control for increasing the speed of seating the valve body 14 against the valve seat 20 is executed each time a certain time elapses or at certain time intervals. The present invention, however, is not limited to this arrangement, but the speed of seating the valve body 14 may be increased each time the number of times of driving the valve body 14 reaches a predetermined value.

While the speed of seating the valve body 14 against the valve seat 20 is increased by increasing the releasing current $I_R$ applied to the lower coil 46, extending the period $T_R$ of supplying the releasing current $I_R$, increasing the attraction current $I_A$ applied to the upper coil 42, extending the period $T_A$ of supplying the attraction current $I_A$, and extending the period $T_M$ of supplying the transition current $I_M$ to the upper coil 42 in the illustrated embodiment, it suffices that at least one of these functions is accomplished.

In the illustrated embodiment, where the engine is in a light-load, low-rotating-speed operating state, the speed increase control is performed with respect to all of the solenoid-operated valves 12 while a certain period of time is assigned to each cylinder for execution of the control. It is, however, possible to perform the speed increase control on each of particular solenoid-operated valves 12 of each cylinder, or perform the speed increase control in a certain order with respect to the respective solenoid-operated valves 12 included in the engine.

In the other embodiment of this invention, a speed of seating the valve body 14 may be increased more when the engine is in a heavy-load, high-rotating-speed operating state than when the engine is in a light-load, low-rotating-speed operating state. That is, current supplied to the electromagnetic coil may is controlled such that the speed of seating the valve body may is increased as the engine speed increases. With the speed of seating the valve body 14 thus increased, carbon can be surely crushed between the valve body 14 and the valve seat 20. If the speed of seating the valve body 14 is increased, operating noise toward that occurs upon collision between the valve body and the valve seat is increased. But, It is generally noted that the operating sound generated by the engine is increased as the engine is bought into a heavy-load, high-rotating-speed operating state. Therefore, even if the speed of seating the valve body 14 is increased when the engine is in a heavy-load, high-rotating-speed operating state, the operating noise toward that occurs upon collision between the valve body and the valve seat 20 is muffled, the operating noise resulting from the speed increase control can be prevented from being offensive to the ear. Thus, the other embodiment makes it more possible to remove carbon by the speed of seating the valve body 14 being increased as engine speed increases, while preventing the operating noise that increases with an increase in the speed of seating the valve body 14 from being offensive to the ear.

What is claimed is:

1. A solenoid-operated valve control apparatus for an internal combustion engine, comprising:

at least one solenoid-operated valve that functions as one of an intake valve and an exhaust valve of the engine, the valve including a valve body, a spring biasing the valve body in a valve closing direction, and rotating the valve body about an axis thereof as the valve body is moved in the valve closing diction, and an electromagnetic coil that generates an electromagnetic force that moves the valve body in the valve closing direction toward a valve seat, a current controller that controls current supplied to the electromagnetic coil so that a valve body speed at which the valve body moves toward the valve seat increases at predetermined points of time to a speed higher than a normal valve body speed.

2. A solenoid-operated valve control apparatus according to claim 1, wherein the current controller increases the valve body speed when an engine operating sound is larger than a predetermined value.

3. A solenoid-operated valve control apparatus according to claim 2, wherein the engine operating sound is larger than the predetermined value when an engine load is larger than a predetermined load.

4. A solenoid-operated valve control apparatus according to claim 2, wherein the engine operating sound is larger than the predetermined value when an engine rotating-speed is larger than a predetermined speed.

5. A solenoid-operated valve control apparatus according to claim 2, wherein the at least one valve includes a plurality of solenoid-operated valves, and wherein, at different points of time, the current controller increases a speed at which the valve body is seated, based on one of the respective solenoid-operated valves and respective groups of the solenoid-operated valves.

6. A solenoid-operated valve control apparatus according to claim 1, wherein the current controller increases the valve body speed each time a given period of time elapses.

7. A solenoid-operated valve control apparatus according to claim 6, wherein the at least one valve includes a plurality of the solenoid-operated valves, and wherein, at different points of time, the current controller increases a speed at which the valve body is seated, based on one of the respective solenoid-operated valves and respective groups of the solenoid-operated valves.

8. A solenoid-operated valve control apparatus according to claim 1, wherein the current controller increases the valve body speed each time the number of times of driving the valve body reaches a predetermined value.

9. A solenoid-operated valve control apparatus according to claim 8, wherein the at least one valve includes a plurality of the solenoid-operated valves, and wherein, at different points of time, the current controller increases the speed at which the valve body is seated, based on one of the respective solenoid-operated valves and respective groups of the solenoid-operated valves.

10. A solenoid-operated valve control apparatus according to claim 1, wherein the current controller increases the valve body speed by carrying out at least one of current increase control and time extension control, the current increase control being performed by increasing a magnitude of a current supplied to the electromagnetic coil, the time extension control being performed by extending a period of time during which the current is supplied to the electromagnetic coil.

11. A solenoid-operated valve control apparatus according to claim 10, wherein the electromagnetic coil comprises an upper coil through which an attraction current flows to generate an attraction force that moves the valve body in the valve closing direction, and a lower coil through which a repulsion current flows to generate a repulsive force that moves the valve body in the valve closing direction, and wherein the current controller performs a current control operation selected from the group comprising increasing the attraction current, extending a period of time during which the attraction current is supplied, extending a period of time during which transition current is supplied to the upper coil, the transition current flowing upon switching from the attraction current to holding current with which the valve body is held in a closed position, increasing the repulsion current, and extending a period of time during which the repulsion current is supplied.

12. A solenoid-operated valve control apparatus according to claim 1, wherein the current controller increases the valve body speed as the engine operating sound increases.

13. A solenoid-operated valve control apparatus according to claim 12, wherein the engine operating sound is increased in response to an increase of an engine rotating-speed and the current controller increases the valve body speed as the engine rotating-speed increases.

14. A method of controlling at least one solenoid-operated valve for an internal combustion engine, the valve functioning as one of an intake valve and an exhaust valve of the engine and including a valve body, a spring biasing the valve body in a valve closing direction, and an electromagnetic coil that generates an electromagnetic force that moves the valve body in the valve closing direction, the method comprising the steps of:

supplying a current to the electromagnetic coil to move the valve body toward a valve seat at a valve body speed;

rotating the valve body about an axis thereof as the valve body is moved in the valve closing direction; and controlling the current supplied to the electromagnetic coil so that the valve body speed increases at certain points of time to a speed higher than a normal valve body speed.

15. A solenoid-operated valve control method according to claim 14, wherein the current supplied to the electromagnetic coil is controlled to increase the valve body speed when an engine operating sound is larger than a predetermined value.

16. A solenoid-operated valve control apparatus according to claim 15, wherein the engine operating sound is larger than the predetermined value when an engine load is larger than a predetermined load.

17. A solenoid-operated valve control apparatus according to claim 15, wherein the engine operating sound is larger than the predetermined value when an engine rotating-speed is larger than a predetermined speed.

18. A solenoid-operated valve control method according to claim 15, wherein the at least one valve includes a plurality of solenoid-operated valves, and wherein the current is controlled to increase the valve body speed at different points of time based on one of the respective solenoid-operated valve and respective groups of the solenoid-operated valves.

19. A solenoid-operated valve control method according to claim 14, wherein the current supplied to the electromagnetic coil is controlled to increase the valve body speed each time a given period of time elapses.

20. A solenoid-operated valve control method according to claim 19, wherein the at least one valve includes a plurality of solenoid-operated valves, and wherein the current is controlled to increase the valve body speed at different points of time based on one of the respective solenoid-operated valve and respective groups of the solenoid-operated valves.

21. A solenoid-operated valve control method according to claim 14, wherein the current is controlled to increase the valve body speed each time a number of times the valve body has been driven reaches a predetermined value.

22. A solenoid-operated valve control method according to claim 21, wherein the at least one valve includes a plurality of solenoid-operated valves, and wherein the current is controlled to increase the valve body speed at different points of time based on one of the respective solenoid-operated valve and respective groups of the solenoid-operated valves.

23. A solenoid-operated valve control method according to claim 14, wherein the valve body speed is increased by carrying out at least one of a current increase control and a time extension control, the current increase control being performed by increasing a magnitude of the current and the time extension control being performed by extending a period of time during which the current is supplied to the electromagnetic coil.

24. A solenoid-operated valve control method according to claim 23, wherein the electromagnetic coil comprises an upper coil through which an attraction current flows to generate an attraction force that moves the valve body in the valve closing direction, and a lower coil through which a repulsion current flows to generate a repulsive force that moves the valve body in the valve closing direction, and wherein the step of controlling the current comprises at least one of the steps of (1) increasing the attraction current, (2) extending a period of time during which the attraction current is supplied, (3) extending a period of time during which a transition current is supplied to the upper coil, the transition current flowing upon a switch over from the attraction current to a holding current which maintains the valve body in a closed position, (4) increasing the repulsion current, and (5) extending a period of time during which the repulsion current is supplied.

25. A solenoid-operated valve control method according to claim 14, wherein the valve body speed is increased as an engine operating sound increases.

26. A solenoid-operated valve control apparatus according to claim 25, wherein the engine operating sound increases according to an increase of an engine rotating-speed and the valve body speed is increased as the engine rotating-speed increases.

* * * * *